United States Patent [19]

Brown

[11] Patent Number: 4,911,136

[45] Date of Patent: Mar. 27, 1990

[54] SLINGSHOT

[76] Inventor: Jim W. Brown, Rte. 1, Box 182, Kinston, Ala. 36453

[21] Appl. No.: 318,335

[22] Filed: Mar. 3, 1989

[51] Int. Cl.[4] ..... F41B 3/00; F41B 5/00

[52] U.S. Cl. ..... 124/20 R; 124/16; 124/25; 124/23 R

[58] Field of Search ..... 124/16, 24 R, 23 R, 124/DIG. 1, 25, 20 R, 17, 20 B

[56] References Cited

U.S. PATENT DOCUMENTS

| | | | |
|---|---|---|---|
| 1,153,415 | 9/1915 | Beaty | 124/20 R |
| 3,918,427 | 11/1975 | Turner | 124/20 B |
| 4,026,032 | 5/1977 | Smith | 124/87 |
| 4,050,438 | 9/1977 | Pfotenhauer | 124/20 R |
| 4,169,453 | 10/1979 | Hunsicker | 124/16 |
| 4,169,456 | 10/1979 | Van House | 124/25 |
| 4,411,248 | 10/1983 | Kivenson | 124/20 R |
| 4,649,891 | 3/1987 | Bozek | 124/DIG. 1 |
| 4,651,707 | 3/1987 | Bozek | 124/20 R |
| 4,703,744 | 11/1987 | Taylor et al. | 124/20 R |

*Primary Examiner*—Randolph A. Reese
*Assistant Examiner*—Anthony Knight
*Attorney, Agent, or Firm*—Richard C. Litman

[57] ABSTRACT

A slingshot is constructed to produce the maximum projectile velocity with a minimum of force exerted by the user and includes a cable assembly cooperating with a plurality of pulley assemblies. A pair of draw pulley assemblies are mounted upon a fixed frame and are joined, by the cables, to a pair of pulley assemblies carried by the free ends of two resilient limbs extending forwardly and upwardly from their attachment to the frame. A handle assembly, fixed relative the frame, includes an arm guard extending forwardly and rearwardly of the frame and is engaged by a substantial length of the user's arm to stabilize the slingshot during its use.

7 Claims, 2 Drawing Sheets

SLINGSHOT

FIELD OF THE INVENTION

This invention relates generally to mechanically actuated projectile devices and more specifically, to slingshots utilizing a compound mechanism of pulleys and cables to achieve a mechanical advantage.

BACKGROUND OF THE INVENTION

The modern slingshot is a progressive version of its medieval counterpart. In the past, the slingshot is known to be comprised of relatively few parts. It is depicted traditionally as a Y-shaped device. Usually attached to the arms of the Y is an elastomeric material. Centered on this elastomer is usually a pouch of some type. When a projectile is placed in the pouch, the pouch is pulled away from the Y-shaped member, and the pouch is released. The potential energy of the elastomer is converted to the kinetic energy of the projectile. The projectile is thrown at a speed corresponding to the force applied by the user in extending or pulling back the pouch.

A disadvantage to existing devices will be immediately evident. The speed of the projectile is dependent upon the strength of the user. Logically, the stronger the user, the more potential energy that will be stored in the elastomeric material and the more kinetic energy that will be imparted to the projectile. For those sporting enthusiasts who enjoy the challenge of the hunt without the aid of more modern weapons, the traditional slingshot does not become a viable choice. Unless the sportsman is extremely strong, the projectile will not acquire a speed sufficient for hunting game.

following the development of the compound bow, a number of improvements may be made to slingshot construction which utilize the enhanced force obtained through a simple application of physics. When multiple cables are connected with the use of cams or eccentric pulleys, greater forces are more easily stored within drawn or deflected resilient arms or limbs of a bow. Thus, with less strength, the user may obtain a projectile velocity of higher magnitude. When applied to a slingshot, such an improvement has clear advantages. The sportsman is able to enjoy the use of a slingshot without the disadvantages of the medieval design.

DESCRIPTION OF THE RELATED ART

Examples of patents which relate to slingshots of the same general nature as the present invention include: U.S. Pat. Nos. 1,153,415 issued to A. Beaty on Sept. 14, 1915, 4,026,032 issued to J.T. Smith on May 31, 1977, 4,169,453 issued to G.G. Hunsicker on Oct. 2, 1979, 1,411,248 issued to G. Kivenson on Oct. 25, 1983, 4,649,891 issued to J.W. Bozek on Mar. 17, 1987, and 4,703,744 issued to S.A. Taylor on Nov. 3, 1987. Each of these patents discloses a mechanical device that serves to throw a projectile, but none, either singly or in combination, disclose the invention as described and claimed herein.

The present invention is based upon the modern development of the compound slingshot. It utilizes a pulley/cam system to multiply the force applied by the user. Thus, it improves upon the aforementioned traditional design and brings the slingshot into the realm of the true sportsman.

SUMMARY OF THE INVENTION

It is an object of the present invention to provide a compound slingshot having the ability of multiplying the force applied by the user of the device.

It is another object of the present invention to provide an improved pulley/cam system which helps in the task of multiplying the force applied by a user upon the draw strings of a slingshot.

A further object of the present invention is to provide a slingshot having a frame providing sufficient strength to withstand the compressive and tensile forces as developed through the action of deflectable limbs controlled by pulleys or cams.

It is yet another object of the present invention to provide a slingshot including a frame a cantilever member adapted to engage a user's forearm to provide an enhanced stability during use of the device.

It is another object of the present invention to provide a means of supporting a slingshot on the arm in such a way as to allow the user to adjust the device without needing to remove it from the arm.

It is another object of the present invention to provide adjustable means to sight the slingshot upon a desired target.

With these and other objects in view which will more readily appear as the nature of the invention is better understood, the invention resides in the novel construction, combination and arrangement of parts hereinafter more fully described and illustrated, with reference being made to the accompanying drawings.

BRIEF DESCRIPTION OF THE DRAWINGS

Similar reference characters designate corresponding parts throughout the various figures of the drawings.

DESCRIPTION OF THE PREFERRED EMBODIMENT

Figure 2:
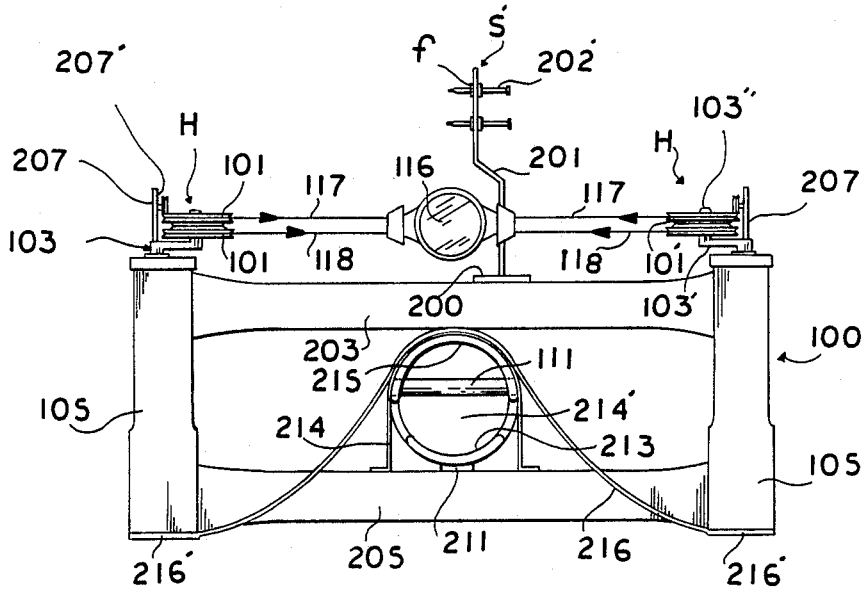
FIG. 2 is a rear elevational view of the apparatus of FIG. 1.

Referring now to the drawings, particularly FIG. 2, the rear elevation of the invention, it can be seen that the slingshot is generally designated S and includes a fixed frame 100. The frame defines a substantially rectangular configuration and includes a pair of vertical side or end frame members 105, joined by an upper horizontal frame member 203 and a parallel, lower horizontal frame member 205. The two end frame members 105 are mirror images of one another and function in coordination with the rigidly affixed upper and lower frame members 203, 205 to support the entire structure and operation of the slingshot. It is upon these individual members that the remaining components of the slingshot are attached.

Extending from the top of each end frame member 105, is a pulley mount 103 having a depending base leg 104 extending downwardly and suitable journalled within a socket 210 or the like embedded within each end frame member 105. An offset, horizontal crank or arm 103' carries an endmost vertical pulley post 103''. Mounted upon each post 103'' are a pair of stacked, horizontally disposed draw cams or eccentrics 101 and an intermediate limb pulley or wheel 101'. The pulley mounts 103 and their attached members 101, 101' will be referred to as horizontal draw assemblies H.

Figure 1:
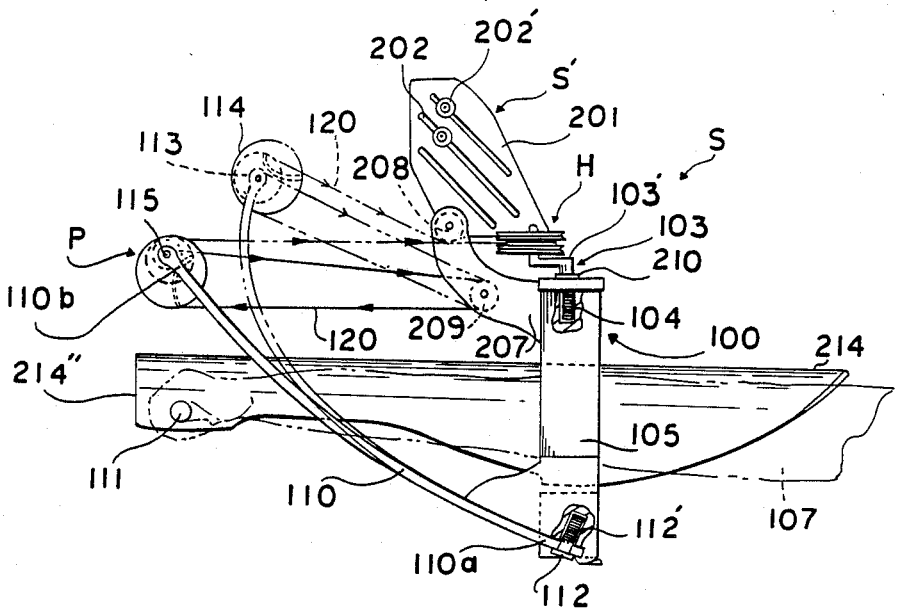
FIG. 1 is a side elevational view showing the slingshot as assembled, illustrating the tensioning limbs of the slingshot both in the relaxed and tensioned positions.

Extending forwardly and upwardly from each vertical frame member 105 is a pulley bracket 207 and which may comprise a thin, flat piece of metal forwardly aligned with the base leg 104 of the pulley mount 103, as shown most clearly in FIG. 1.

Two vertically spaced idle wheels 208, 209 are mounted on the inner face 207' of each bracket 207 with the upper wheel or guide element 208 disposed with its bottom point located substantially coplanar with the topmost one of the draw cams 101 while the lower wheels or guide elements 209 will be seen from FIG. 1 to be mounted at a point below the plane of the horizontal draw assembly crank arms 103'.

The upper horizontal frame member 203 extends between and is attached adjacent the top portions of each of the vertical frame members 105, and attached to the horizontal frame member 203 is a sight assembly S' including a support base plate 200. A sight arm 201 projects upwardly from the support base plate 200 and is provided with a plurality of parallel, inclined slots 202 each adapted to receive a sighting post 202'. Releasable fastening members f for each post 202' permit both transverse as well as vertical adjustment thereof with respect to each slot in order to vary the user's line of sight with respect to both windage and elevation factors.

The lower horizontal frame member 205 is a key element in the construction of the slingshot S as many components are attached to it that help with the functioning of the slingshot. A support block 211 atop the medial portion of the horizontal frame member 205 serves to retain a bottom, arcuate armrest 212 in place. The armrest 212 preferably includes suitable cushioning means or padding 213 to make the armrest 212 comfortable to use, while an inverted U-shaped arm guard 214 will be seen to overlie the armrest 213 and extends longitudinally a substantial distance forward and rearward of the lower frame member 205. The arm guard 214 is also provided with appropriate padding 215 to insure comfort during use of the slingshot S.

Adjacent the forward end 214'' of the arm guard 214, within the interior 214' thereof, is a transverse handgrip 111 and which is attached to the arm guard to allow the user to firmly hold the slingshot S while in use. As depicted, the grip 111 may consist of a cylindrical bar, but it is understood that the grip is not limited to this construction. For example, the grip assembly 111 may be constructed in such a way as o provide grooves in its body to accommodate human fingers. The manner of grasping the device, say with the left arm and hand 107 is depicted in FIG. 1.

In order to balance more rigidly the slingshot S upon the arm 107, additional feature is provided in the form of an arm guard support 216 comprising a metal strap overlying the arm guard and having its two ends 216' attached to the bottom of the vertical end frame members 105. The arm guard rigid support 216 has two functions. First, it provides the user of the slingshot S with rigid means holding the slingshot steady when the user is drawing and firing a projectile. Second, the arm guard rigid member 216 provides alternate means to attach the arm guard 214 to the main frame of the slingshot.

The propelling force of the slingshot is provided by two resilient limbs 110 each having a stationary rear end 110a attached to the bottom of one of the end frame members 105 by a removable fastener 112 engaging a threaded socket 112' within the frame member. Each limb 110 extends to a position forward of the vertical frame members 105 above the arm guard 214 and terminates in a pulley end **110*b*** supporting a pulley assembly P.

A pair of vertically disposed limb pulley assemblies P each include an inner wheel 113 fixedly joined to an adjacent outer cam or eccentric 114 and journalled on an axle 115 carried by the limb end **110*b*. As will be seen from FIG. 1, the wheel 113 is centered relative the axle 115 while the cam 114 is eccentrically carried by the axle 115**.

Figure 3A:
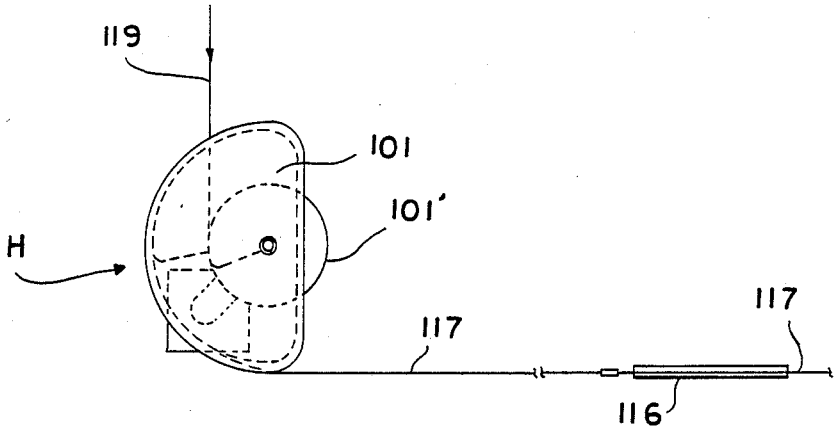
FIG. 3A is a top plan view of one horizontal pulley assembly of the slingshot as it appears in the relaxed position.
Figure 3B:
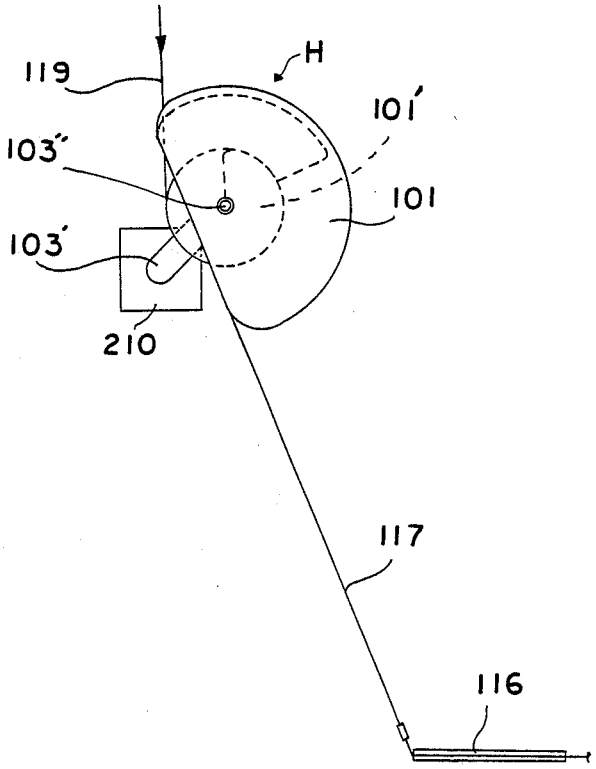
FIG. 3B is a view similar to FIG. 3A but of the horizontal pulley assembly when the slingshot is fully drawn.

In the use of the slingshot S, a suitable projectile (not show) is positioned within, and grasped by means of a pouch or retainer 116 shown in FIG. 2. This pouch 116 is located above the frame upper member 203 and supported at either side by upper and lower draw cables 117–118, respectively. The draw cables 117–118 are respectively sheaved about and anchored to the two stacked draw cams 101 such that, upon the rearward displacement of the pouch 116, the cams 101 are angularly displaced as shown in FIGS. 3A–3B. During this displacement, the intermediate draw wheels 101', which are fixed relative the adjacent cams 101, are rotated and wind up the frame ends 119 of two limb cables 120.

Each limb cable 120 will be seen from FIG. 1 to extend forward to one limb pulley assembly P where it is sheaved about the inner wheel 113, passes diametrically and laterally therethrough and is thence sheaved about the larger diameter eccentrically mounted wheel or cam 114. The cable then passes from the lower portion of the cam 114 and extends rearwardly and about the bracket-mounted idle wheel 209 before returning to the limb tip where it is anchored about the pulley axle 115.

With the above construction in mind it will be seen that upon the rearward drawing of the projectile pouch 116, a first mechanical advantage is provided by the horizontal draw assemblies H which partially wind the limb cables 120 that in turn, develop a further mechanical advantage during the displacement of the limb tips from the full line to the broken line position as shown in FIG. 1. The foregoing mechanical advantage is similar to that as achieved with the cam wheels as employed in the well known compound archery bows. During the tensioning of the two limbs 110, the frame ends 119 of the two cables 120 engage the bottom portion of the bracket-mounted guide wheels 208, thus insuring the horizontal disposition of the cable free ends 119 in the area of the draw wheels 101'.

The above described slingshot S provides an improved apparatus whereby a user supports a rigid frame 100 by grasping a handle 111 associated with an arm guard 214, to retain the slingshot in a stable manner while the other hand grasps a pouch containing a projectile. Upon pulling back on the projectilecontaining pouch, two pairs of draw cables 117–118 angularly displace two horizontal draw assemblies H to wind up two limb cables 120, respectively acting upon vertically disposed pulley assemblies P carried at the free ends of resilient limbs 110. The compound mechanical advantage as produced by the two sets of pulley assemblies act in concert to permit the ready deflection of the limbs 110 whereupon, when the user releases the drawn pouch 116, the projectile therein is directed forwardly at an extremely high rate of speed.

It is to be understood that the present invention is not limited to the sole embodiment described herein but encompasses all embodiments falling within the scope of the appended claims.

I claim:

1. A slingshot comprising:

a fixed frame assembly including a horizontal frame member joined to opposite end frame members;

means for holding the slingshot fixed relative said frame, a draw assembly containing a plurality of rotatable elements mounted adjacent each said end frame member;

a pair of laterally spaced apart resilient limbs attached to said frame each having a free end disposed forward of said frame;

a pulley assembly containing a plurality of rotatable elements mounted adjacent each said limb free end;

a cable assembly joined to a projectile pouch disposed intermediate said end frame members; and said cable assembly including cables leading from said pouch, about said draw assemblies, thence about said limb pulley assemblies, whereby drawing of said pouch rearwardly displaces said cables to deflect said limbs upwardly and rearwardly toward said frame prior to release of the pouch and directing of a projectile therein in a forward direction.

2. A slingshot according to claim 1, wherein, said end frame members comprise vertically disposed members having top and bottom portions, said horizontal frame member comprising an upper frame member joined to said end frame members adjacent said top portions, a lower horizontal frame member joined to said end frame members adjacent said bottom portions, said means for holding the slingshot including an arm guard disposed between said upper and lower frame members and having opposite portions extending forwardly and rearwardly of said frame assembly, and handgrip means fixed to said arm guard adjacent said forwardly extending portion.

3. A sling shot according to claim 1 wherein, said draw assembly rotatable elements include a pair of cam elements and a wheel intermediate said cam elements, and means mounting said cam elements and wheels for rotation about a vertically disposed axis.

4. A slingshot according to claim 3 including, guide means fixed relative said frame and disposed forwardly of said draw assemblies, whereby as said limbs are deflected upwardly and rearwardly said cables intermediate said draw and pulley cables are engaged by

5. A slingshot according to claim 1 wherein, each said pulley assembly includes a wheel and adjacent cam element, and means mounting said adjacent wheel and cam element for rotation about a horizontally disposed axis.

6. A slingshot according to claim 1 including, an adjustable sight assembly mounted upon said horizontal frame member.

7. A slingshot according to claim 1 including, a bracket extending forwardly of said frame adjacent each said end frame member, a vertically disposed idle wheel mounted on each said bracket, and said cables leading from said pulley assemblies rearwardly about said idle wheels and thence back to said pulley assemblies.

* * * * *